US008828153B2

(12) United States Patent
Haga et al.

(10) Patent No.: US 8,828,153 B2
(45) Date of Patent: Sep. 9, 2014

(54) HIGH-STRENGTH COLD-ROLLED STEEL SHEET AND HIGH-STRENGTH PLATED STEEL SHEET

(75) Inventors: Jun Haga, Nishinomiya (JP); Nobusato Kojima, Amagasaki (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 12/962,950

(22) Filed: Dec. 8, 2010

(65) Prior Publication Data

US 2011/0073218 A1 Mar. 31, 2011

Related U.S. Application Data

(63) Continuation of application No. PCT/JP2005/023600, filed on Dec. 22, 2005, which is a continuation of application No. 12/003,945, filed on Jan. 3, 2008, now abandoned.

(30) Foreign Application Priority Data

Jul. 4, 2005 (JP) ..... 2005-195368

(51) Int. Cl.

| | |
|---|---|
| ***C22C 38/32*** | (2006.01) |
| ***C21D 9/46*** | (2006.01) |
| ***C23C 2/06*** | (2006.01) |
| ***C21D 7/02*** | (2006.01) |
| ***C21D 9/48*** | (2006.01) |
| ***C22C 38/18*** | (2006.01) |
| ***C21D 8/04*** | (2006.01) |
| ***C21D 7/13*** | (2006.01) |
| ***C23C 2/28*** | (2006.01) |
| ***C23C 2/40*** | (2006.01) |
| ***C22C 38/02*** | (2006.01) |

(52) U.S. Cl.

CPC . *C22C 38/18* (2013.01); *C23C 2/06* (2013.01); *C21D 7/02* (2013.01); *C21D 9/48* (2013.01); *C21D 2211/005* (2013.01); *C21D 8/0405* (2013.01); *C21D 8/0463* (2013.01); *C21D 2211/008* (2013.01); *C21D 7/13* (2013.01); *C22C 35/04* (2013.01); *C23C 2/28* (2013.01); *C23C 2/40* (2013.01); *C22C 38/02* (2013.01)

USPC ..... 148/333; 148/330; 148/661; 420/103; 420/104; 420/120; 420/121

(58) Field of Classification Search

USPC ..... 148/579, 601–603, 648–654, 660–664, 148/500, 503–507, 320, 328, 330, 333, 334

See application file for complete search history.

(56) References Cited

U.S. PATENT DOCUMENTS

| | | | | |
|---|---|---|---|---|
| 5,558,727 | A * | 9/1996 | Miura et al. | 148/333 |
| 6,586,117 | B2 * | 7/2003 | Nomura et al. | 428/659 |
| 6,638,371 | B1 | 10/2003 | Mochida et al. | |

FOREIGN PATENT DOCUMENTS

| | | |
|---|---|---|
| JP | 55-50455 | 4/1980 |
| JP | 56-90926 | 7/1981 |

(Continued)

OTHER PUBLICATIONS

Computer-generated translation of JP 07-300623, originally published in the Japanese language on Nov. 14, 1995.*

*Primary Examiner* — Roy King
*Assistant Examiner* — Vanessa Luk
(74) *Attorney, Agent, or Firm* — Clark & Brody

(57) ABSTRACT

A high-strength cold-rolled steel sheet providing a product with a good surface condition after press forming, having excellent bake hardenability and anti room temperature aging property, and having a dual phase structure with a tensile strength of at least 340 MPa is provided. A high-strength cold-rolled steel sheet has a structure comprising a main phase which is a ferrite and a secondary phase which is a low temperature transformation product including a martensite and has a hardness distribution of the ferrite phase in an arbitrary cross section having a length of 10 mm in the widthwise 10 direction of the sheet which satisfies the relationship prescribed by $(HV_{(max)}-HV_{(ave)})<0.5\times(Hv_{(ave)}$. $HV_{(max)}$ is the maximum Vickers hardness of ferrite grains in a region at a distance of from (1/8)t to (1/4)t in the thickness direction from the surface when the thickness of the high-strength cold-rolled steel sheet is t, and $Hv_{(ave)}$ is the average Vickers hardness of ferrite grains in this region.

8 Claims, 4 Drawing Sheets

(56) References Cited

FOREIGN PATENT DOCUMENTS

| | | |
|---|---|---|
| JP | 56-146826 | 11/1981 |
| JP | 59-31827 | 2/1984 |
| JP | 59-38337 | 3/1984 |
| JP | 07-300623 | 11/1995 |
| JP | 8-176723 | 7/1996 |
| JP | 9-125161 | 5/1997 |
| JP | 9-227955 | 9/1997 |
| JP | 11-6028 | 1/1999 |
| JP | 11-335781 | 12/1999 |
| JP | 2003-129172 | 5/2003 |
| JP | 3569949 | 7/2004 |

* cited by examiner

HIGH-STRENGTH COLD-ROLLED STEEL SHEET AND HIGH-STRENGTH PLATED STEEL SHEET

TECHNICAL FIELD

This invention relates to a high-strength cold-rolled steel sheet and a high-strength plated steel sheet which can be formed into various shapes by press forming or the like and methods for their manufacture. Specifically, the present invention relates to a high-strength cold-rolled steel sheet and a high-strength plated steel sheet capable of providing a product having a good surface condition after press forming, a good bake hardenability, and a good anti room temperature aging property.

BACKGROUND ART

As technical fields in industry become highly specialized, special high-level performance is now required of the materials used in each technical field. For example, cold-rolled steel sheet which is used after being formed into various shapes by press forming or the like is often required to have a high strength. Therefore, the use of high-strength cold-rolled steel sheet is now being envisaged. In particular, increasing the fuel efficiency of automobiles by decreasing the weight of vehicle bodies in order to protect the global environment is becoming an important topic. Accordingly, there is an increasing demand for high-strength cold-rolled steel sheet which makes it possible to achieve a decrease in the thickness of steel sheet for automobiles.

Steel sheet used for outer panels of automobiles such as outer panels of doors and for fenders requires dent resistance, i.e., the property that permanent deformation does not take place if the sheet is pressed with a finger or hit by a pebble. Dent resistance increases as the yield stress after paint-baking subsequent to press forming increases and as the sheet thickness increases. Therefore, if steel sheet having a high yield stress is used as an outer panel of an automobile, the desired dent resistance can be achieved even if the sheet thickness is decreased.

Steel sheet used for outer panels of automobiles is also required to have the ability to conform to a press die during press forming and to develop little springback when a formed article is released from a press die, i.e., to have good shape fixability. Therefore, steel sheet used in outer panels of automobiles is required to have a low yield stress before press forming.

Thus, a steel sheet for an outer panel of an automobile is required to have a low yield stress before press forming and a high yield stress after being subjected to press forming and paint-baking (painting and baking).

Bake hardenable steel sheet (BH steel sheet) is known to have such properties. BH steel sheet is steel sheet which utilizes the so-called strain age hardening phenomenon in which the yield stress increases due to solid solution C and N atoms segragating to dislocations and locking the dislocations. If BH steel sheet is used as steel sheet for an automobile, dislocations which are introduced at the time of press forming are locked by solid solution C and N at the time of paint-baking, so the yield stress after paint-baking increases. Improving the bake hardenability of high-strength steel sheet also leads to an improvement in dent resistance and shape fixability.

There have been many proposals concerning BH steel sheet. For example, Patent Documents 1 and 2 disclose a manufacturing method for a BH steel sheet having excellent deep drawability by adding Ti and Nb to ultra-low carbon steel and further adding Si, Mn, and P to increase tensile strength. However, this method has the following problems (a)-(c).

(a) In order to increase tensile strength, solid solution strengthening elements such as Si, Mn, and P are added, resulting not only in an increase in tensile strength but also M an increase in yield stress. As a result, shape fixability deteriorates, and surface distortion more easily develop.

(b) It is difficult to achieve both bake hardenability and anti room temperature aging property. In order to guarantee anti room temperature aging property, the amount of bake hardenability is restricted.

(c) At the time of press forming, linear surface defects easily develop. Namely, surface defects which develop when carrying out press forming of a BH steel sheet often are linear surface defects in the form of recesses and indentations, and they do not disappear after painting. Such surface defects become a serious problem if they develop in an outer panel of an automobile requiring a beautiful appearance such as a roof or hood or door.

Patent Documents 3-5 disclose a method of manufacturing a low carbon Al-killed steel sheet having a dual phase structure in which martensite is dispersed in ferrite (referred to below as a dual phase steel sheet). This dual phase steel sheet has a high tensile strength and a low yield stress. In addition, it does not undergo room temperature aging even when bake hardenability is large and has excellent ductility. Above-described problems (a) and (b) can be solved by using this dual phase steel sheet, but problem (c) cannot be solved.

In order to prevent this type of surface defect, Patent Documents 6 and 7 disclose an invention which decreases surface defects in a P-added cold-rolled steel sheet, Patent Document 8 discloses a method of manufacturing a Ti, Nb-added ultra-low carbon steel sheet which has excellent surface qualities, and Patent Document 9 discloses a method of manufacturing a very-low carbon cold-rolled steel sheet having excellent surface qualities.

Patent Document 1: JP S59-31827 A1
Patent Document 2: JP S59-38337 A1
Patent Document 3: JP S55-50455 A1
Patent Document 4: JP S56-90926 A1
Patent Document 5: JP S56-146826 A1
Patent Document 6: JP H11-6028 A1
Patent Document 7: JP H11-335781 A1
Patent Document 8: JP H09-227955 A1
Patent Document 9: JP H09-125161 A1

DISCLOSURE OF INVENTION

The inventions disclosed in Patent Documents 6 and 7 decrease variations in hardness inside a steel sheet caused by segregation of P by suppressing the segregation of P and adding suitable amounts of Si and Mn, whereby the occurrence of surface defects is prevented. However, due to the addition of P, Mn, and Si in those inventions, the yield stress increases, so it is not possible to avoid a deterioration in shape fixability and resistance to surface distortion. Giving a steel sheet a dual phase structure is effective at decreasing the yield stress. However, according to the results of investigations by the present inventors, although the inventions disclosed in Patent Documents 6 and 7 can suppress surface defects in a steel sheet having a single phase structure of ferrite, the occurrence of surface defects in a dual phase steel sheet cannot be suppressed.

In the inventions disclosed in Patent Documents 8 and 9, the yield stress at the time of cooling subsequent to annealing is predicted based on the yield stress and tensile strength at room temperature, and by controlling the cooling rate, surface defects are prevented. However, according to the results of investigation by the present inventors, these inventions cannot suppress the occurrence of surface defects in a dual phase steel sheet.

The present invention was made in light of the above-described problems of the prior art, and its object is to provide a high-strength cold-rolled steel sheet and a high-strength plated steel sheet which can be used after forming into various shapes by press forming or the like, which can form a product having a good surface condition after press forming, and which has both excellent bake hardenability and anti room temperature aging property as well as to provide methods for their manufacture.

Specifically, the object of the present invention is to provide a high-strength cold-rolled steel sheet and a high-strength plated steel sheet which can provide a product having a good surface condition after press forming, which have excellent bake hardenability and anti room temperature aging property, and which have a dual phase structure with a tensile strength of at least 340 MPa, as well as to provide methods for their manufacture.

The present inventors performed detailed preliminary tests in order to investigate the effects of the metallurgical structure, added elements, and annealing conditions on the surface condition of a dual phase steel sheet after working. In this description, percent with respect to the content of steel components means mass percent.

The composition of the test steel used in this preliminary test was C: at most 0.03%, Si: 0.01%, Mn: at most 4.0%, P: 0.01%, S: 0.005%, sol. Al: 0.05%, N: 0.003%, Cr: at most 4.0%, and a remainder of Fe and impurities.

After a slab having this composition was heated to 1240° C., it was hot rolled at a temperature range of at least 900° C. and then coiled at 600° C., the resulting hot-rolled steel sheet was pickled, and then it was cold rolled with a rolling reduction of 80% to a sheet thickness of 0.8 mm to obtain a cold-rolled steel sheet. Using a continuous annealing simulator, the cold-rolled steel sheet was heated to at least 750° C. and held at that temperature for 30 seconds, and then it was cooled to room temperature at various cooling rates ranging from at least 5° C./sec to at most 500° C./sec. After a tensile strain of 5% was imparted to the resulting annealed sheet, its surface was rubbed with an oil whetstone and observed for the presence or absence of linear surface defects.

The hardness distribution of ferrite in the interior of the vicinity of portions where surface defects developed and in normal portions was measured. The hardness distribution was found by measuring the distribution of the Vickers hardness (load of 0.0098 N) of ferrite grains in the sheet widthwise direction within a region at least 0.1 mm and at most 0.2 mm measured from the surface towards the interior of an annealed sheet. The metallurgical structure of the annealed sheet had a main phase of ferrite and a secondary phase of martensite or a low temperature transformation product including martensite and bainite. No substantial difference was observed between the composition of the slab and that of the annealed sheet.

Next, the following experiment was carried out in order to clarify the relationship between the surface condition and the added elements or annealing conditions. Using a continuous annealing simulator, a cold-rolled steel sheet obtained by the above-described method was heated to at least 750° C. and held at that temperature for 30 seconds, then it was cooled to 650° C. at a cooling rate of 3° C./sec, then it was rapidly cooled from 650° C. to the slow cooling starting temperature Ts (° C.) at a cooling rate of 60° C./sec, then it was slowly cooled from the slow cooling starting temperature Ts (° C.) to the slow cooling finishing temperature Tf (° C.) at a cooling rate of 5° C./sec. It was then rapidly cooled to room temperature at a cooling rate of 60° C./sec. The resulting annealed sheet was subjected to temper rolling with an elongation of 0.5%, and after a tensile strain of 5% was then imparted to the sheet, the surface of the annealed sheet was rubbed with an oil whetstone and observed for the presence or absence of surface defects.

In addition, from the standpoint of yield behavior at high temperatures, the following experiment was carried out to investigate the cause of linear surface defects. Using a continuous annealing simulator, a cold-rolled steel sheet obtained by the above-described method was heated to at least 750° C. and held at that temperature for 30 seconds. It was then cooled to 650° C. at a cooling rate of 3° C./sec, and rapid cooling at a cooling rate of 60° C./sec was commenced from 650° C. and interrupted at a rapid cooling terminating temperature Tt (° C.), and then a tensile test was immediately carried out at the rapid cooling terminating temperature Tt (° C.).

The following results (A)-(F) were obtained from these preliminary tests. As a result of further investigations, the present invention was completed.

(A) FIG. 1 is a graph showing the hardness distribution of ferrite grains in the sheet widthwise direction in a portion where surface defects occurred and its periphery. FIG. 2 is a graph showing the hardness distribution of ferrite grains in the sheet widthwise direction in a normal portion without surface defects. In the graphs of FIGS. 1 and 2, $Hv_{(max)}$ indicates the maximum Vickers hardness of ferrite grains in the measurement region (10 mm wide), and $Hv_{(ave)}$ indicates the average Vickers hardness of ferrite grains in this measurement region. From the graphs in FIGS. 1 and 2, it can be seen that surface defects develop in the portions where the hardness of ferrite grains is abruptly higher than in the periphery.

(B) Specifically, surface defects develop in portions where the difference $\{Hv_{(max)}-Hv_{(ave)}\}$ between $Hv_{(max)}$ and $Hv_{(ave)}$ is at least 0.5 times $Hv_{(ave)}$.

(C) The higher the cooling rate after annealing, the larger is the difference $\{Hv_{(max)}-Hv_{(ave)}\}$ between $Hv_{(max)}$ and $Hv_{(ave)}$, and the more easily surface defects occur.

It is conjectured that the causes of these phenomena are that (a) when a tensile strain is imparted to a dual phase steel sheet, primarily ferrite undergoes plastic deformation, but if there are variations in hardness of ferrite grains, softer portions preferentially undergo plastic deformation, and the cross-sectional shape of harder portions becomes bumpy, (b) as the hardness difference in ferrite increases, the degree of bumpiness which develops in the thickness direction of a steel sheet after deformation becomes severe, and (c) as the cooling rate increases, thermal stresses due to uneven cooling increase, localized plastic deformation develops during cooling, and plastically deformed portions are hardened compared to their periphery.

(D) If a dual phase steel sheet is subjected to a tensile test at room temperature, it undergoes continuous yielding, and yield point elongation does not appear. However, if a tensile test is carried out in the middle of cooling after annealing, depending upon the test temperature, discontinuous yielding takes place and yield point elongation occurs.

The reason for this fact is thought to be that if ferrite coexist with a low temperature transformation product, movable dislocations are introduced into the interior of the ferrite and continuous yielding takes place. However, in a high temperature region in mid course of cooling after annealing, a low temperature transformation product is not formed or the amount thereof which is formed is small.

(E) FIGS. 3 and 4 are graphs showing the relationship between the rapid cooling terminating temperature Tt, the sum of the Mn content and the Cr content, and the yield behavior when carrying out a tensile test at the rapid cooling terminating temperature Tt. FIG. 3 shows the case when the C content is 0.01%, and FIG. 4 shows the case when the C content is 0.03%. In the graphs of FIGS. 3 and 4, the hollow circles (○) show the case when continuous yielding was observed, and the solid circles (●) show the case in which discontinuous yielding occurred.

As shown in the graphs of FIGS. 3 and 4, yield behavior shows a clear relationship with the C content, the sum of the Mn content and the Cr content, and the tensile test temperature. Discontinuous yielding develops in the temperature range between temperature $T_1$ given by the following Equation (2) and temperature $T_2$ given by the following Equation (3).

$$T_1(^\circ\,C.)=445+200\times C-50\times(Mn+Cr) \quad (2)$$

$$T_2(^\circ\,C.)=330-2000\times C-30\times(Mn+Cr) \quad (3)$$

Namely, the temperature range in which discontinuous yielding develops rises as the C content increases and as the sum of the Mn content and the Cr content decreases, and it decreases as the C content increases and as the sum of the Mn content and the Cr content increases.

The reason for this is conjectured to be that discontinuous yielding is induced by C atoms segregating to dislocations, so segregation becomes easier and the temperature region in which discontinuous yielding occurs widens as the C content increases and that as the Mn content and the Cr content increase, a low temperature transformation product is formed at a lower temperature, and the temperature region in which discontinuous yield occurs shifts downwards.

(F) FIGS. 5-8 are graphs showing the relationship of the occurrence of surface defects with the slow cooling starting temperature Ts, the slow cooling finishing temperature Tf, temperature $T_1$, and temperature $T_2$. FIG. 5 shows the case in which the C content is 0.01%, the Mn content is 1.0%, and the Cr content is 0.5%. FIG. 6 shows the case in which the C content is 0.03%, the Mn content is 1.0%, and the Cr content is 0.5%. FIG. 7 shows the case in which the C content is 0.01%, the Mn content is 2.0%, and the Cr content is 1.0%. FIG. 8 shows the case in which the C content is 0.03%, the Mn content is 2.0%, and the Cr content is 1.0%. In the graphs of FIGS. 5-8, the open squares (□) show cases in which surface defects did not develop, and the solid squares (■) show cases in which surface defects developed.

As shown by the graphs in FIGS. 5-8, it can be seen that surface defects develop when the slow cooling starting temperature Ts is lower than temperature $T_1$ and when the slow cooling finishing temperature Tf is higher than temperature $T_2$. Namely, surface defects develop when a steel sheet is rapidly cooled in a temperature region in which discontinuous yield takes place.

The reason for this is conjectured to be that when a steel sheet undergoes discontinuous yielding, the amount of localized plastic deformation due to thermal stresses during rapid cooling particularly increases, and due to the added effect of strain age hardening, the plastically deformed portions markedly harden compared to the periphery thereof.

From these results (A)-(F), it can be seen that by performing slow cooling in a specific temperature region prescribed by the C content, the Mn content, and the Cr content in a cooling step after annealing, the occurrence of linear surface defects after press forming can be prevented.

The present invention is a high-strength cold-rolled steel sheet characterized by having a structure comprising a main phase which is a ferrite phase and a secondary phase which is a low temperature transformation product including martensite with the hardness distribution of the ferrite phase in an arbitrary cross section having a length of 10 mm in the widthwise direction of the sheet satisfying the following Equation (1):

$$Hv_{(max)}-Hv_{(ave)}<0.5\times Hv_{(ave)} \quad (1).$$

In this Equation (1), $Hv_{(max)}$ is the maximum Vickers hardness of ferrite grains in a region where the distance from the surface in the depth direction is at least (⅛)t and at most (¼)t when the thickness of the high-strength cold-rolled steel sheet is t, and $Hv_{(ave)}$ is the average Vickers hardness of ferrite grains in this region.

By way of example, the high-strength cold-rolled steel sheet according to this invention has a steel composition comprising C: at least 0.0025% and less than 0.04%, Si: at most 0.5%, Mn: at least 0.5% and at most 2.5%, P: at most 0.05%, S: at most 0.01%, sol. Al: at most 0.15%, N: less than 0.008%, Cr: at least 0.02% and at most 2.0%, and a remainder of Fe and impurities. In this case, the steel composition preferably contains B: at most 0.003% and/or Mo: at most 1.0%, or Ti: at most 0.1% as optional added elements.

From another standpoint, the present invention is a high-strength plated steel sheet characterized by comprising the above-described high-strength cold-rolled steel sheet as a base metal having a plating layer on its surface.

From another standpoint, the present invention is a method of manufacturing a high-strength cold-rolled steel sheet having a structure comprising a main phase which is a ferrite phase and a secondary phase which is a low temperature transformation product including martensite, the method being characterized by comprising the following steps (A) and (B):

(A) a step of carrying out hot rolling and cold rolling on a steel ingot or a slab having the above-described steel composition to form a steel sheet; and (B) a step of subjecting the steel sheet to continuous annealing by soaking the steel sheet at a temperature of at least the $Ac_1$ transformation point and lower than the $Ac_3$ transformation point, then cooling at a cooling rate of 15-200° C./sec in the temperature range from 650° C. to 450° C., and then cooling at a cooling rate of less than 10° C./sec in the temperature range from temperature $T_1$ (° C.) given by the following Equation (2) to temperature $T_2$ (° C.) given by the following Equation (3).

$$T_1(^\circ\,C.)=445+200\times C-50\times(Mn+Cr) \quad (2)$$

$$T_2(^\circ\,C.)=330-2000\times C-30\times(Mn+Cr) \quad (3)$$

The symbols for elements in Equation (2) and Equation (3) indicate the contents (in mass percent) of the respective elements in the steel.

The present invention is also a method of manufacturing a high-strength steel sheet having a structure comprising a main phase which is a ferrite phase and a secondary phase which is a low temperature transformation product including martensite, the method being characterized by comprising the below-described steps (A) and (C):

(A) a step of carrying out hot rolling and cold rolling of a steel ingot or a slab having the above-described steel composition to form a steel sheet, and (C) a step of subjecting the steel sheet to continuous annealing by soaking at a temperature of at least the $Ac_3$ transformation point and lower than ($Ac_3$ transformation point+100° C.), then cooling at a cooling rate of 15-200° C./sec in a temperature range from 650° C. to 450° C., and then cooling at a cooling rate of less than 10° C./sec in a temperature range from temperature $T_1$ (° C.) given by above Equation (2) and temperature $T_2$ (° C.) given by the above Equation (3).

From yet another standpoint, the present invention is a method of manufacturing a high-strength plated steel sheet characterized by subjecting a high-strength cold-rolled steel sheet manufactured by the above-described manufacturing method according to the present invention to plating.

According to the present invention, it is possible to manufacture a high-strength cold-rolled steel sheet and a high-strength plated steel sheet having a dual phase structure with a tensile strength of at least 340 MPa which have sufficient formability to be subjected to working such as press forming, which have excellent bake hardenability and anti room temperature aging property, and which do not develop surface defects when undergoing press forming.

A high-strength cold-rolled steel sheet and a high-strength plated steel sheet according to the present invention can contribute to solving global environmental problems through a decrease in the weight of automobile bodies.

BEST MODE FOR CARRYING OUT THE INVENTION

Figure 1:
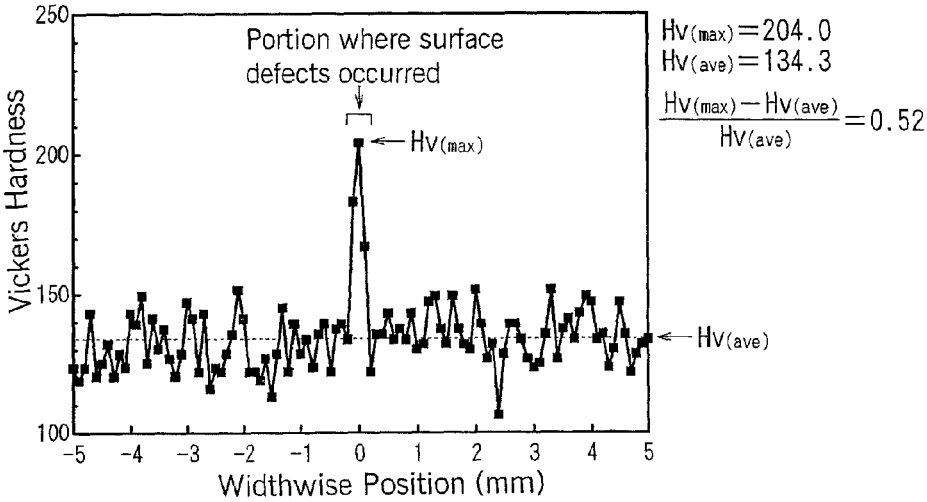
FIG. 1 is a graph showing the hardness distribution of ferrite grains in the widthwise direction of a sheet in a portion where surface defects occur and in the periphery thereof.
Figure 2:
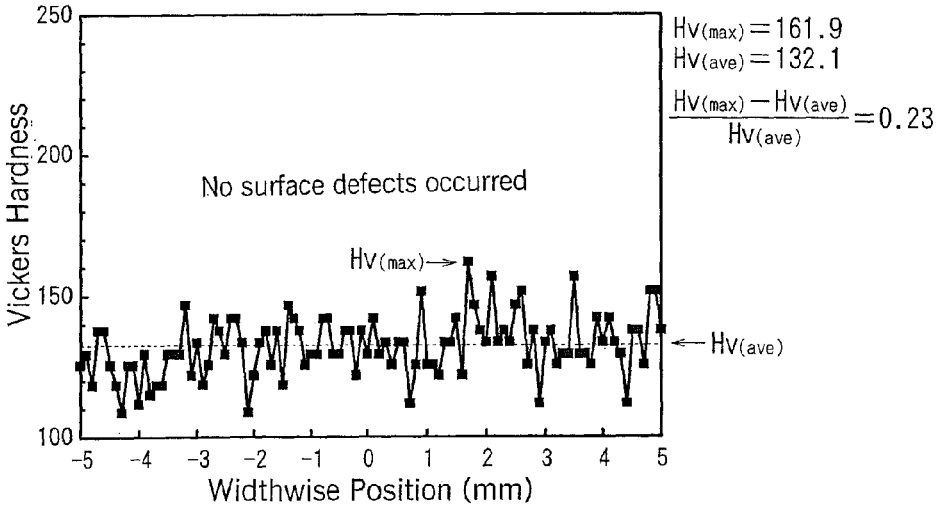
FIG. 2 is a graph showing the hardness distribution of ferrite grains in the widthwise direction of a sheet in a normal portion having no surface defects.
Figure 3:
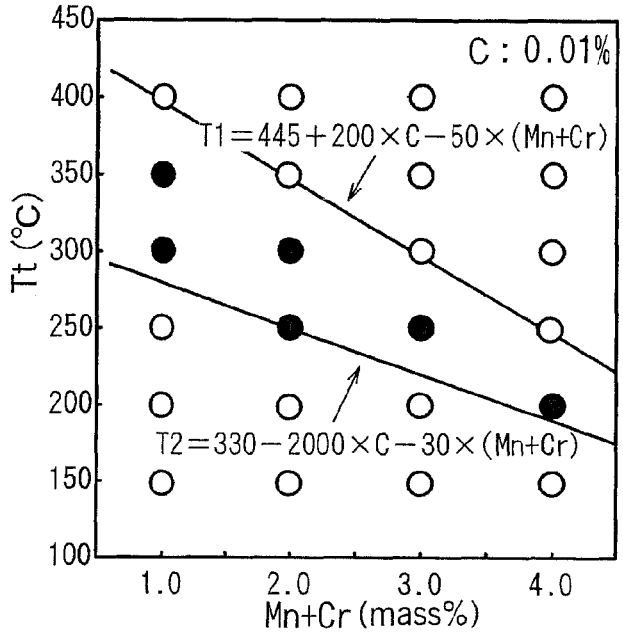
FIG. 3 is a graph showing the relationship of the rapid cooling terminating temperature Tt and the sum of the Mn content and the Cr content to the yield behavior in a tensile test carried out at the rapid cooling terminating temperature Tt when the C content was 0.01%.
Figure 4:
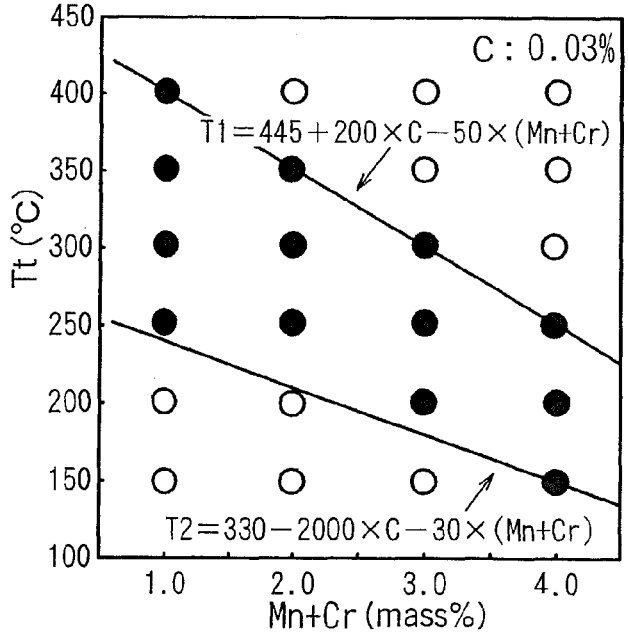
FIG. 4 is a graph showing the relationship of the rapid cooling terminating temperature Tt and the sum of the Mn content and the Cr content to the yield behavior in a tensile test carried out at the rapid cooling terminating temperature Tt when the C content was 0.03%.
Figure 5:
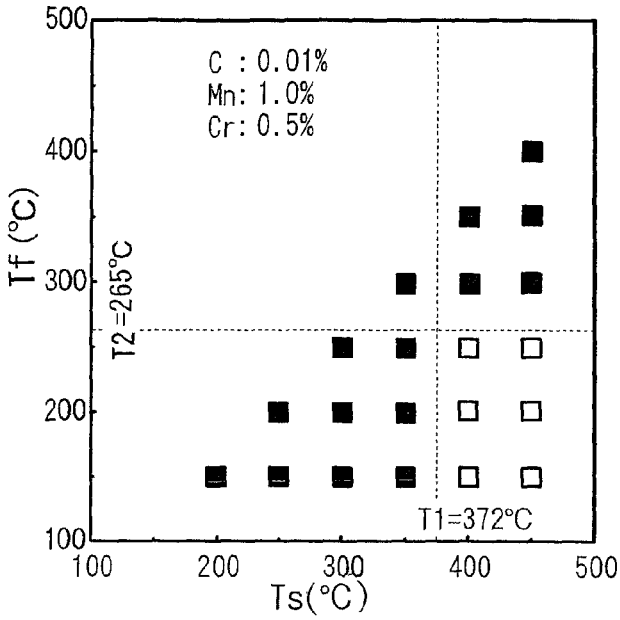
FIG. 5 is a graph showing the relationship of the slow cooling starting temperature Ts, the slow cooling finishing temperature Tf, temperature $T_1$, and temperature $T_2$ to the occurrence of surface defects when the C content was 0.01%, the Mn content was 1.0%, and the Cr content was 0.5%.
Figure 6:
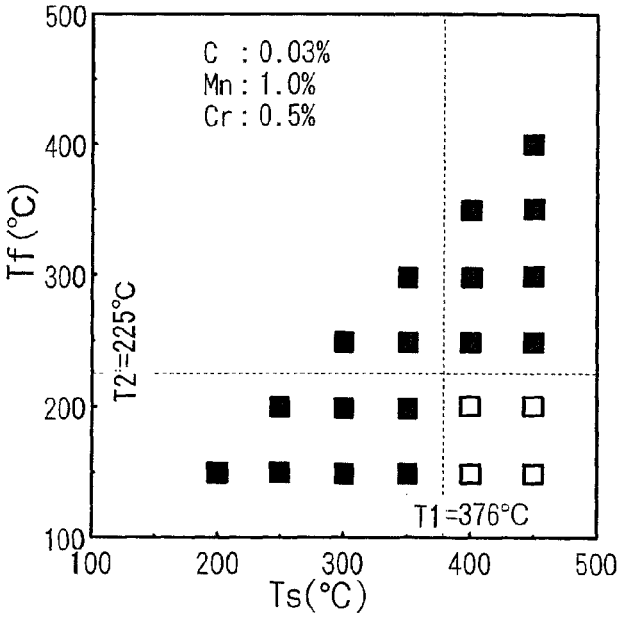
FIG. 6 is a graph showing the relationship of the slow cooling starting temperature Ts, the slow cooling finishing temperature Tf, temperature $T_1$, and temperature $T_2$ to the occurrence of surface defects when the C content was 0.03%, the Mn content was 1.0%, and the Cr content was 0.5%.
Figure 7:
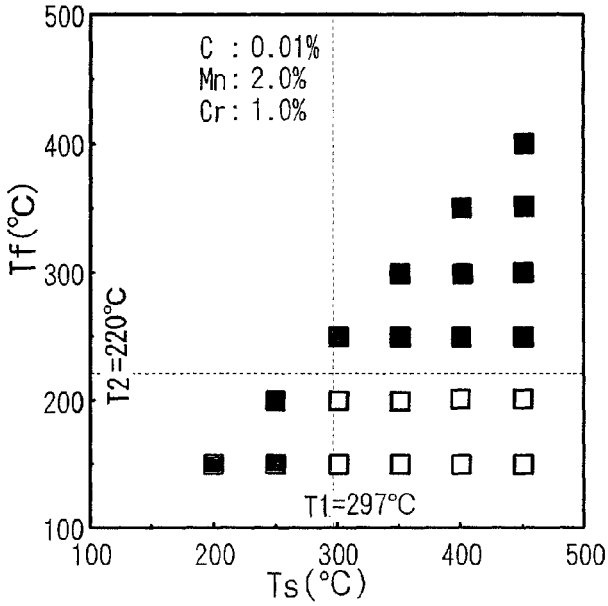
FIG. 7 is a graph showing the relationship of the slow cooling starting temperature Ts, the slow cooling finishing temperature Tf, temperature $T_1$, and temperature $T_2$ to the occurrence of surface defects when the C content is 0.01%, the Mn content is 2.0%, and the Cr content is 1.0%.
Figure 8:
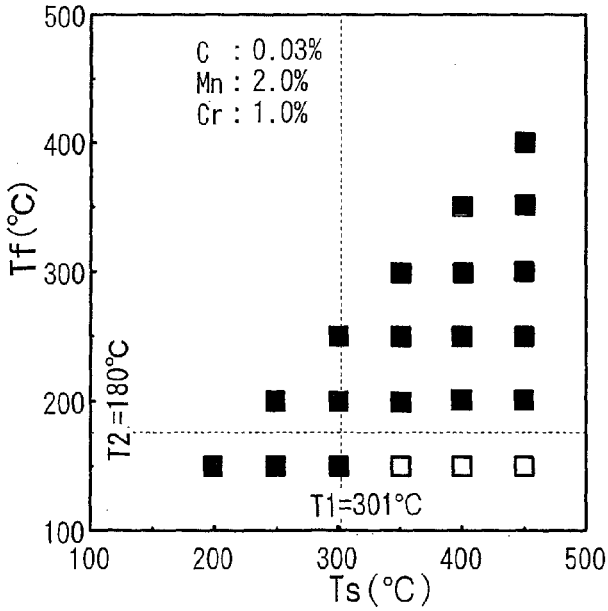
FIG. 8 is a graph showing the relationship of the slow cooling starting temperature Ts, the slow cool cooling finishing temperature Tf, temperature $T_1$, and temperature $T_2$ to the occurrence of surface defects when the C content is 0.03%, the Mn content is 2.0%, and the Cr content is 1.0%.

Below, best modes of a high-strength cold-rolled steel sheet, a high-strength plated steel sheet, and methods for their manufacture according to the present invention will be explained in detail.

The reasons for the limitations on (a) the metallurgical structure, (b) the composition, and (c) the manufacturing conditions of a high-strength cold-rolled steel sheet of this mode (of carrying out the invention) will be explained in sequence.

(a) Metallurgical Structure

A high-strength cold-rolled steel sheet of this mode has a dual phase structure in which a low temperature transformation product including martensite is dispersed in a ferrite phase. As a result of this dual phase structure, the yield stress of the steel sheet is decreased to provide good press formability and resistance to surface distortion, and high bake hardenability can be obtained without impairing anti room temperature aging property.

The term "low temperature transformation product" used herein refers to a structure formed by a low temperature transformation, such as martensite or bainite. Another example is an acicular ferrite phase.

The overall volume percentage of the low temperature transformation product is preferably greater than 3%. The low temperature transformation product may include two or more types of phase such as martensite and bainite. If the volume percentage of the martensite phase increases too much, the yield stress increases and shape fixability and resistance to surface distortion deteriorates. Therefore, the volume percentage of the martensite phase is preferably less than 10% or the low temperature transformation product includes both martensite and bainite. It is still more preferable if the volume percentage of the martensite phase is less than 3%. If the volume percentage of the low temperature transformation product becomes too high, tensile strength increases too much and ductility and deep drawability deteriorate. Therefore, the volume percentage of the low temperature transformation product is preferably less than 15% and more preferably less than 12%.

From the standpoint of resistance to surface distortion, the yield stress of the steel sheet is preferably at most 300 MPa and still more preferably at most 270 MPa.

From the standpoint of press formability, the tensile strength of the steel sheet is preferably less than 590 MPa. In addition to a ferrite phase and a low temperature transformation product, the steel sheet may contain a retained austenite phase. In order to maintain good anti room temperature aging property, the volume percentage of a retained austenite phase is preferably smaller than the overall volume percentage of the low temperature transformation product and is preferably less than 3%.

A high-strength cold-rolled steel sheet according to this mode has a hardness distribution of the ferrite phase in an arbitrary cross section having a length of 10 mm in the widthwise direction of the sheet which satisfies the relationship given by above-described Equation (1): $Hv_{(max)}-Hv_{(ave)}<0.5\times Hv_{(ave)}$. The occurrence of linear surface defects at the time of press forming is prevented by satisfying the relationship of this Equation (1).

In Equation (1), $Hv_{(max)}$ means the maximum Vickers hardness of ferrite grains when measuring the Vickers hardness distribution of ferrite grains in a portion having the length of 10 mm in the sheet widthwise direction in a region at a depth measured from the surface of at least (⅛)t and at most (¼)t in the case of a cold-rolled steel sheet having a thickness t or in a region at a depth of at least (1/8)t and at most (1/4)t from the interface between a base metal having a thickness t and a plating layer in the case of a plated steel sheet. $Hv_{(ave)}$ means the average Vickers hardness of ferrite grains in this region.

The Vickers hardness of ferrite grains is measured by polishing a cross section of a steel sheet, exposing the metallurgical structure by etching with a nital solution or the like, and then measuring the hardness of the central portion of each ferrite grain. There is no particular restriction on the load at this time, but it is preferably made approximately 0.0098 (N) so that the resulting indentation does not extend to the grain boundary or the interface with the secondary phase.

Determination of $Hv_{(max)}$ and $Hv_{(ave)}$ is carried out by measuring the hardness of ferrite grains at 100 or more nearly equally spaced points over a portion having a length of 10 mm in the widthwise direction of a sheet. The maximum measured value is made $Hv_{(max)}$, and the average value of all the measurements is made $Hv_{(ave)}$. Preferably, the hardness distribution of the ferrite phase in an arbitrary cross section having a length of 10 mm in the widthwise direction of the sheet satisfies the following Equation (4).

$$Hv_{(max)}-Hv_{(ave)}<0.4\times Hv_{(ave)} \quad (4)$$

A high-strength steel sheet of this mode has the above-described metallurgical structure.

(b) Composition

A high-strength cold-rolled steel sheet of this mode has the following composition in order to further increase ductility and anti room temperature aging property.

C: at least 0.0025% and less than 0.04%

If the C content is less than 0.0025%, the above-described dual phase structure is no longer obtained, while if the C content is at least 0.04%, the ductility and deep drawability of the steel sheet are impaired. Accordingly, in this mode, the C content is made at least 0.0025% and less than 0.04%. A preferred range is at least 0.011% and at most 0.029%. A more preferred range is at least 0.015% and at most 0.029%.

Si: at most 0.5%

Si is an element which is unavoidably contained in steel. It worsens ductility, and it markedly deteriorates the phosphatability of cold-rolled steel sheet and the platability of plated steel sheet. Accordingly, the Si content is preferably as low as possible. However, Si exerts a strengthening action on a steel sheet, so in this mode, up to 0.5% of Si may be contained in order to strengthen steel. Preferably the Si content is at most 0.1% and more preferably at most 0.02%.

Mn: at least 0.5% to at most 2.5%

Mn has the effect of increasing the hardenability of steel, and at least 0.5% of Mn is contained in this mode in order to disperse a low temperature transformation product in a ferrite phase. If too much Mn is contained, ductility and deep drawability deteriorate. Therefore, in this mode, the upper limit on the Mn content is made 2.5%. Preferably the Mn content is at least 1.0% and less than 2.0% and more preferably it is at least 1.0% and less than 1.5%.

P: at most 0.05%

P is an element which is unavoidably contained in steel, and it segregates to grain boundaries and worsens anti second-cold-work embrittlement property and weldability. Accordingly, the P content is preferably as small as possible. However, P can strengthen steel inexpensively without impairing deep drawability to a great extent. Therefore, in this mode, P may be contained in an amount of at most 0.05% in order to obtain a desired strength. Preferably the lower limit on P is 0.01% and the upper limit thereon is 0.035%.

S: at most 0.01%

S is an impurity which is unavoidable contained in steel. Because it segregates to grain boundaries and thus embrittles steel, the S content is preferably as low as possible. In this mode, the S content is made at most 0.01%.

sol. Al: at most 0.15%

Al is used for deoxidation of molten steel. However, if Al is contained in excess of 0.15%, its effect saturates and it becomes uneconomical. Therefore, in this mode, the sol. Al content is made at most 0.15%. Al combines with N to form MN and prevents aging caused by N, so the content of Al is preferably made at least 10 times the N content.

N: less than 0.008%

N is an element which is unavoidably contained in steel. Increasing the N content deteriorates ductility, deep drawability, and anti room temperature aging property. Accordingly, in this mode, the N content is made less than 0.008%. A preferred range for N is less than 0.005%, and a more preferred range is less than 0.004%.

Cr: at least 0.02% to at most 2.0%

Cr has the effect of increasing the hardenability of steel without damaging ductility, and in order to disperse a low temperature transformation product in a ferrite phase, at least 0.02% of Cr is contained in this mode. If too much Cr is contained, deep drawability deteriorates, and the phosphatability of a cold-rolled steel sheet or the platability of a plated steel sheet deteriorates. Accordingly, in this mode, the upper limit on the Cr content is made 2.0%. A preferred range is at least 0.05% to at most 1.0%. In order to further improve ductility, the Cr content is preferably at least 1/10 the Mn content.

In this mode, the following elements may be contained as optional added elements. These optional added elements will be explained.

B: at most 0.003% and/or Mo: at most 1.0%

There is no particular need for the steel to contain B and Mo. However, one or both thereof may be contained in order to further improve the hardenability of steel. However, B worsens deep drawability, so its upper limit is made 0.003%. A preferred range for B is at least 0.0002% and less than 0.002%. If Mo is contained in excess of 1.0%, its effect saturates and it becomes uneconomical, so its content is made at most 1.0%. A preferred range for Mo is at least 0.02% and less than 0.5%.

Ti: at most 0.1%

There is no particular need for the steel to contain Ti. However, Ti combines with N to form TiN and prevents aging by N, so Ti may be contained in the steel. However, if Ti is contained in excess of 0.1%, its effect saturates and it becomes uneconomical. Therefore, the Ti content is made at most 0.1%. There is no particular restriction on its lower limit, but preferably the Ti content is at least 0.003% and at most 0.025%.

In addition to the above-described elements, the steel composition contains Fe and impurities.

A high-strength cold-rolled steel sheet according to this mode has the above-described composition.

(c) Manufacturing Conditions

A steel having the above-described composition is melted by a suitable means and then formed into ingots by a continuous casting method, or it is formed into an ingot by a desired casting method and then formed into a slab by a method such as blooming. The resulting ingot or slab is subjected to hot rolling after reheating. Alternatively, hot rolling may be performed on a hot ingot after continuous casting or a hot slab after blooming without reheating or after auxiliary heating. In this description, such an ingot or slab will be collectively referred to as a slab as a steel material for use in hot rolling.

There are no particular restrictions on the hot rolling conditions. However, if finish rolling is carried out in an austenite low temperature region, the crystal grains of the resulting hot rolled steel sheet are refined thereby causing a recrystallization texture suitable for deep drawing to develop at the time of annealing. For this purpose, final reduction is preferably carried out in the temperature range of at least the $Ar_3$ transformation point to at most ($Ar_3$ transformation point+100° C.).

In order to carry out final reduction in this temperature range, at the stage between rough rolling and finish rolling, the roughly rolled material may be heated. In this case, it is desirable that heating be performed so that the temperature of the rear end of the roughly rolled material is higher than that of the front end thereof, thereby suppressing the variation in temperature over the entire length of the roughly rolled material at the start of finish rolling to at most 140° C. As a result, the uniformity of the product properties within a coil is improved.

By way of example, heating of the roughly rolled material can be performed by providing a solenoid-type induction heating apparatus between a roughing mill and a finishing mill and controlling the increase in temperature by heating based on the temperature distribution in the lengthwise direction measured on the upstream side of the induction heating apparatus.

After the completion of hot rolling, the steel sheet is cooled and coiled. Since scale formation leads to a yield loss, coiling is preferably performed at a temperature of lower than 600° C. In order to adequately precipitate AlN and suppress aging due to N, the lower limit on the coiling temperature is preferably made 450° C.

After the hot rolled steel sheet is subjected to de-scaling by pickling or the like, it is cold rolled according to a conventional manner. Cold rolling is preferably carried out with a reduction ratio of at least 70% to a sheet thickness of less than 1.0 mm in order to produce a recrystallization texture suitable for deep drawing by recrystallization annealing which is carried out subsequent to cold rolling.

A cold-rolled steel sheet which is obtained in this manner is, if necessary, subjected to treatment such as degreasing in accordance with a known method and then subjected to recrystallization annealing. The soaking temperature at the time of recrystallization annealing is in the range of at least the $Ac_1$ transformation point and lower than the $Ac_3$ transformation point in order to make the metallurgical structure of the steel a dual phase structure having a main phase which is ferrite and a secondary phase which is a low temperature transformation product including martensite. If the soaking temperature is lower than the $Ac_1$ transformation point, a low temperature transformation product is no longer obtained. However, in order to coarsen the ferrite after annealing and increase ductility, it is possible for the soaking temperature to be in the range of at least the $Ac_3$ transformation point and lower than ($Ac_3$ transformation point+100° C.).

If the soaking temperature is too high, ferrite excessively coarsens and a surface roughening occurs at the time of press forming. Therefore, when trying to achieve an increase in ductility by coarsening of ferrite in the above-described manner, the upper limit on the soaking temperature is lower than ($Ac_3$ transformation point+100° C.). A preferred upper limit is lower than ($Ac_3$ transformation point+50° C.).

The $Ac_1$ transformation point means the starting temperature of the ferrite to austenite transformation at the time of heating, and the $Ac_3$ transformation point means the finishing temperature of the ferrite to austenite transformation at the time of heating.

If the heating rate is too high, ferrite is refined, and this leads to a deterioration in ductility. Therefore, the heating rate up to the soaking temperature is preferably less than 60° C./sec.

At the cooling stage after soaking in recrystallization annealing, cooling in the temperature range from 650° C. to 450° C. is performed at a cooling rate of at least 15° C./sec to at most 200° C./sec. If the cooling rate in this temperature range is less than 15° C./sec, the amount of ferrite becomes too large, and the anti room temperature aging property deteriorates. On the other hand, if the cooling rate in this temperature range exceeds 200° C./sec, the flatness of the steel sheet deteriorates. A preferred cooling rate is at least 50° C./sec and at most 150° C./sec, and a more preferred cooling rate is greater than 60° C./sec and less than 130° C./sec.

There are no particular limitations on a method of cooling from the soaking temperature to 650° C. However, in order to increase the stability of austenite and facilitate the formation of a low temperature transformation product, when soaking in a temperature range of at least the $Ac_1$ transformation point and lower than the $Ac_3$ transformation point, cooling in a temperature range from the soaking temperature to (soaking temperature−50° C.) is preferably performed at a cooling rate of less than 10° C./sec. When performing soaking in the temperature range of at least the $Ac_3$ transformation point to lower than ($Ac_3$ transformation point+100° C.), cooling in the temperature range from the soaking temperature to (soaking temperature−100° C.) is preferably performed at a cooling rate of less than 10° C./sec.

In this mode, in recrystallization annealing, a cooling rate of less than 10° C./sec is employed during cooling in the temperature range from temperature $T_1$ prescribed by Equation (2) ($=445+200\times C-50\times(Mn+Cr)$) and temperature $T_2$ prescribed by Equation (3) ($=330-2000\times C-30\times(Mn+Cr)$).

The reason for this cooling rate is that if cooling is carried out at a cooling rate of at least 10° C./sec in the temperature range of from temperature $T_1$ to temperature $T_2$, as described above, as a result of thermal stresses, a steel sheet locally undergoes plastic deformation and a variation in hardness develops inside the steel sheet. As a result, linear surface defects develop at the time of press forming. A preferred cooling rate in this temperature range is less than 6° C./sec and a more preferred cooling rate is less than 3° C./sec. There is no particular lower limit on the cooling rate, but in order to prevent a deterioration in press formability and anti room temperature aging property by degeneration of the low temperature transformation product due to tempering and the like, the cooling rate is preferably at least 6° C./min.

There is no particular restriction on a cooling method in a temperature range lower than temperature $T_2$. However, in order to increase bake hardenability, cooling in a temperature range of 150° C. or lower is preferably at a rate of at least 10° C./sec.

A cold-rolled steel sheet which is obtained in this manner may be subjected to temper rolling in accordance with usual methods. However, a high rate of elongation in temper rolling leads to a decrease in ductility. Therefore, the rate of elongation in temper rolling is preferably at most 1.0%. A more preferred rate of elongation is at most 0.5%.

When manufacturing an electroplated steel sheet, a cold-rolled steel sheet manufactured by the above-described method is subjected to electroplating according to a conventional manner. There is no particular limitation on the type of plating which is formed, but zinc-based plating such as zinc plating, zinc-nickel alloy plating, or the like is preferred. Temper rolling may be carried out after electroplating.

When manufacturing a hot dip plated steel sheet, a cold-rolled steel sheet manufactured by the above-described method is subjected to hot dip plating according to conventional manner. Hot dip plating may be followed by reheating for alloying. There is no particular limit on the type of plating which is formed, but zinc-based plating is preferred. Temper rolling may be carried out after hot dip plating.

When manufacturing hot dip galvanized steel sheet, it may be manufactured by a process comprising recrystallization annealing in the above-described manner, soaking, then cooling in the temperature range of from 650° C. to 460° C. at a cooling rate of greater than 60° C./sec and less than 130° C./sec, hot dip galvanizing by immersion in a molten zinc bath, if necessary galvannealing heat treatment, and cooling in the temperature range between temperature $T_1$ prescribed by Equation (2) and temperature $1'_2$ prescribed by Equation (3) at a cooling rate of less than 3° C./sec.

The structure of a steel sheet which is manufactured in this manner has a main phase which is ferrite and a secondary phase which is a low temperature transformation product including martensite. In this description, "main phase" means the phase having the maximum volume percent, and "secondary phase" means a phase other than the main phase. Accordingly, the secondary phase includes the low temperature transformation product.

Thus, a high-strength cold-rolled steel sheet and a high-strength plated steel sheet manufactured by this mode have a tensile strength of at least 340 MPa and sufficient formability to be applied to working such as press forming as well as excellent bake hardenability and anti room temperature aging property. In addition, they do not develop surface defects when they undergo press forming. Therefore, the high-strength cold-rolled steel sheet and high-strength plated steel sheet are particularly suitable for use in panels of automotive parts and particularly for outer panels of automobiles.

EXAMPLE 1

This invention will be explained more specifically while referring to examples.

Steels having the compositions set forth in Table 1 were melted in a laboratory vacuum remelting furnace and cast. The resulting steel ingots were hot forged to form into 30 mm slabs, and the slabs were heated to 1240° C. and held at that temperature for one hour using an electric heating furnace. After the slabs were withdrawn from the furnace, they were hot rolled in a temperature range of at least 900° C. with a laboratory hot rolling mill to obtain hot rolled steel sheets with a thickness of 5 mm.

TABLE 1

| | Chemical Composition (%) (Remainder: Fe and unavoidable impurities) | | | | | | | | | | |
|---|---|---|---|---|---|---|---|---|---|---|---|
| Steel | C | Si | Mn | P | S | sol. Al | N | Cr | Ti | B | Mo |
| A | 0.051 | 0.03 | 1.53 | 0.016 | 0.004 | 0.031 | 0.0024 | 0.34 | — | — | |
| B | 0.022 | 0.01 | 1.38 | 0.014 | 0.004 | 0.046 | 0.0021 | 0.87 | — | — | |
| C | 0.029 | 0.01 | 1.16 | 0.015 | 0.004 | 0.052 | 0.0023 | 0.33 | | 0.0009 | 0.2 |
| D | 0.028 | 0.02 | 1.46 | 0.015 | 0.004 | 0.055 | 0.0021 | 0.55 | 0.013 | — | |
| E | 0.018 | 0.01 | 1.50 | 0.014 | 0.004 | 0.042 | 0.0024 | 0.41 | | 0.0014 | |

After hot rolling, the sheets were immediately cooled by water spraying to 550° C., which was made the coiling temperature, and they were placed into an electric heating furnace held at this temperature in which they were held at that temperature for one hour and then oven cooled at a cooling rate of 20° C. per hour to simulate post-coiling slow cooling. Both sides of the resulting steel sheets underwent grinding to obtain materials for cold rolling with a thickness of 4 mm, which were subjected to cold rolling with a reduction of 85%.

Using a continuous annealing simulator, the resulting cold-rolled steel sheets were held for 30 seconds at 780° C., then they were slowly cooled to 700° C. at a cooling rate of 3° C./sec and then to 130° C. at the various cooling rates shown in Table 2, and they were then held at 130° C. for 120 seconds and cooled to room temperature at a rate of 15° C./sec.

A test piece with a width of 10 mm was then cut from the annealed sheets or from the electroplated steel sheets resulting from electroplating treatment of the annealed sheets, and it was subjected to a hardness test. In the hardness test, the Vickers hardness (load of 0.0098 N) of ferrite grains was measured at a pitch of approximately 0.1 mm over a distance of 10 mm in the sheet widthwise direction at a position 0.1 mm in the direction toward the center of the thickness of the sheet from the surface of the annealed steel sheet or from the interface between the base metal of the plated steel sheet and the plating layer. The maximum value of the resulting Vickers hardness of the ferrite grains was made $Hv_{(max)}$, the average value thereof was made $Hv_{(ave)}$, and the value calculated by $(Hv_{(max)}-Hv_{(ave)})/Hv_{(ave)}$ was used as an index of the hardness distribution of ferrite grains.

The surface condition after working was evaluated by cutting a test piece having a length of 500 mm in the rolling direction and a width of 200 mm from the annealed sheets, imparting a tensile strain of 5% to the test piece, rubbing the surface with an oil whetstone, and observing whether there were surface defects.

A tensile test was carried out using a JIS No. 5 tensile test piece taken from the annealed sheets in the widthwise direction of the sheets, and the yield stress (YS), the tensile strength (TS), and the yield point elongation (YPE) were determined.

The bake hardenability was evaluated by taking a JIS No. 5 tensile test piece from the annealed sheets in the widthwise direction, imparting thereto a 2% tensile pre-strain, then subjecting it to heat treatment at 170° C. for 20 minutes, and then subjecting the test piece to a tensile test. The difference between the resulting yield stress (YS) and the 2% flow stress was made the amount of bake hardenability (BH), which was used as an index of bake hardenability.

Anti room temperature aging property was evaluated by taking a JIS No. 5 tensile test piece from the annealed sheets in the widthwise direction, holding the test piece for 3 months in an electric furnace set at 40° C., then subjecting it to a tensile test and measuring the yield point elongation (YPE).

The results of evaluation of properties are shown in Table 2. The value of $(Hv_{(max)}-Hv_{(ave)})/Hv_{(ave)}$ was calculated from the hardness distribution at 10 locations on the steel sheet, and the maximum value thereof was recorded.

TABLE 2

| Test No. | Steel | Cooling rate (° C./s) | Steel Type | Microstructure | (Hv(max) − Hv(ave))/ Hv(ave) | Surface defects | YS (MPa) | TS (MPa) | YPE (%) | BH (MPa) | YPE (%) after aging | Comments |
|---|---|---|---|---|---|---|---|---|---|---|---|---|
| 1 | A | 0.5 | CR | F | 0.10 | No | 302 | 466 | 3.5 | 75 | 5.9 | X |
| 2 | A | 5 | CR | F + M + B | 0.19 | No | 264 | 489 | 0.0 | 63 | 0.0 | ○ |
| 3 | A | 100 | EG | F + M | 0.53 | Yes | 266 | 562 | 0.0 | 58 | 0.0 | X |
| 4 | B | 1 | CR | F | 0.15 | No | 279 | 363 | 2.6 | 68 | 5.6 | X |
| 5 | B | 8 | EG | F + M + B | 0.26 | No | 230 | 402 | 0.0 | 55 | 0.1 | ○ |
| 6 | B | 150 | CR | F + M + B | 0.51 | Yes | 234 | 425 | 0.0 | 50 | 0.0 | X |
| 7 | C | 0.5 | CR | F | 0.09 | No | 284 | 380 | 1.4 | 62 | 2.1 | X |
| 8 | C | 7 | CR | F + M | 0.17 | No | 236 | 411 | 0.0 | 51 | 0.0 | ○ |
| 9 | C | 100 | EG | F + M | 0.51 | Yes | 213 | 476 | 0.0 | 43 | 0.0 | X |
| 10 | D | 1 | CR | F | 0.14 | No | 302 | 392 | 2.1 | 65 | 3.8 | X |
| 11 | D | 8 | EG | F + M + B | 0.18 | No | 248 | 419 | 0.0 | 58 | 0.1 | ○ |
| 12 | D | 150 | CR | F + M | 0.55 | Yes | 242 | 445 | 0.0 | 51 | 0.0 | X |
| 13 | E | 1 | CR | F | 0.12 | No | 277 | 352 | 2.9 | 70 | 4.8 | X |
| 14 | E | 7 | EG | F + M + B | 0.16 | No | 211 | 388 | 0.0 | 59 | 0.0 | ○ |
| 15 | E | 150 | CR | F + M + B | 0.55 | Yes | 216 | 410 | 0.0 | 55 | 0.0 | X |

Notes:
1. The cooling rate is the result of measurement at the center in the widthwise direction of a steel sheet.
2. Steel type: CR indicates cold-rolled steel sheet, and EG indicates electroplated steel sheet.
3. Microstructure: F indicates ferrite, M indicates martensite, and B indicates bainite.
4. Surface defects: No indicates that surface defects did not develop, and Yes indicates that surface defects developed.
5. YPE after aging is the YPE after holding for 3 months in a furnace at 40 degrees C.
6. Comments: CICRLE indicates an example of the present invention, and X indicates a comparative example.

Test numbers 2, 5, 8, 11, and 14 for which the metallurgical structure had a ferrite phase and a low temperature transformation product containing martensite and for which the value of $(Hv_{(max)}-Hv_{(ave)})/Hv_{(ave)}$ was less then 0.5 did not have any occurrence of surface defects while exhibiting a high bake hardenability of at least 51 MPa, YPE after aging was at most 0.1%, and they exhibited good anti room temperature aging property.

In contrast, test numbers 1, 4, 7, 10, and 13 had a metallurgical structure that was a single phase of ferrite, so YPE after aging was large and anti room temperature aging property was poor.

For test numbers 3, 6, 9, 12, and 15, the value of $(Hv_{(max)}-Hv_{(ave)})/Hv_{(ave)}$ was larger than 0.5, so surface defects developed in the surface of the steel sheet after working, and the surface condition was poor.

EXAMPLE 2

Steels having the chemical compositions shown in Table 1 were melted in a laboratory vacuum remelting furnace and cast into ingots. The resulting ingots were formed by hot forging into 30 mm slabs, they were heated to 1240° C. and held at that temperature for one hour using an electric heating furnace. After the slabs were removed from the furnace, they were subjected to hot rolling in a temperature range of at least 900° C. with a laboratory hot rolling mill to obtain hot rolled steel sheets with a thickness of 4 mm.

After hot rolling, the steel sheets were immediately cooled to 500° C. by water spray cooling, and this temperature was made the coiling temperature. The steel sheets were then placed into an electric heating furnace maintained at this temperature and held therein for one hour, and then they were oven cooled at a cooling rate of 20° C. per hour to simulate slow cooling after coiling. The resulting steel sheets were pickled and then cold rolled with a reduction of 85%.

Using a continuous hot dip galvanizing simulator, the resulting cold-rolled steel sheets were heated to 790° C. at a heating rate of 20° C./sec and held at that temperature for 60 seconds, then they were cooled to 460° C. at a cooling rate of 70° C./sec, and then they were immersed for 3 seconds in a molten zinc bath at 460° C. to carry out hot dip galvanizing. Immediately after plating or after performing galvannealing heat treatment by holding at 500° C. for 20 seconds, the sheets were cooled to room temperature at the various cooling rates shown in Table 3.

A test piece having a width of 10 mm was taken from the hot dip galvanized steel sheets and subjected to a hardness test. In the hardness test, the Vickers hardness (load of 0.0098 N) of ferrite grains was measured at a pitch of approximately 0.1 mm over 10 mm in the widthwise direction at a position 0.1 mm towards the center of the thickness of the sheet from the interface between the base metal of the plated steel sheet and the plating layer. The maximum value of the resulting Vickers hardness of the ferrite grains was made $Hv_{(max)}$, the average value was made $Hv_{(ave)}$, and $(Hv_{(max)}-Hv_{(ave)})/Hv_{(ave)}$ was calculated and used as an index of the hardness distribution of ferrite grains.

The surface condition after working was evaluated by imparting a 5% tensile strain to the resulting hot dip galvanized steel sheet, rubbing the surface with an oil whetstone, and then observing it for the presence or absence of surface defects.

A tensile test was carried out using a JIS No. 5 tensile test piece taken in the widthwise direction of the sheet. The yield stress (YS), the tensile strength (TS), and the yield point elongation (YPE) were determined.

Bake hardenability was determined by taking a JIS No. 5 tensile test piece in the widthwise direction of the sheet, imparting a 2% tensile pre-strain to it, subjecting it to heat treatment at 170° C. for 20 minutes, and then subjecting it to a tensile test. The difference between the resulting YS and 2% flow stress was made the amount of bake hardenability (BH), which was used as an index of bake hardenability.

Anti room temperature aging property was evaluated by holding a JIS No. 5 tensile test piece taken in the widthwise direction of the sheet in an electric furnace set at 40° C. for 3 months and then performing a tensile test to measure the yield point elongation (YPE).

The results of evaluation of properties are shown in Table 3. The value of $(Hv_{(max)}-Hv_{(ave)})/Hv_{(ave)}$ was calculated from the hardness distribution at 10 arbitrary locations on the steel sheet, and the maximum value thereof was recorded.

TABLE 3

| Test No. | Steel | Alloying treatment | Cooling rate (° C./s) | Microstructure | (Hv(max) − Hv(ave))/Hv(ave) | Surface defects | YS (MPa) | TS (MPa) | YPE (%) | BH (MPa) | YPE (%) after aging | Comments |
|---|---|---|---|---|---|---|---|---|---|---|---|---|
| 16 | A | No | 0.3 | F | 0.12 | No | 283 | 444 | 3.7 | 72 | 5.5 | X |
| 17 | A | No | 2.8 | F + M | 0.23 | No | 247 | 524 | 0.0 | 56 | 0.0 | ○ |
| 18 | A | No | 70 | F + M | 0.51 | Yes | 266 | 582 | 0.0 | 53 | 0.0 | X |
| 19 | B | Yes | 0.5 | F | 0.14 | No | 271 | 348 | 2.4 | 62 | 4.7 | X |
| 20 | B | Yes | 2.6 | F + M + B | 0.24 | No | 222 | 390 | 0.0 | 50 | 0.1 | ○ |
| 21 | B | Yes | 70 | F + M | 0.52 | Yes | 218 | 407 | 0.0 | 49 | 0.0 | X |
| 22 | C | Yes | 0.3 | F + B | 0.16 | No | 270 | 366 | 1.8 | 60 | 2.2 | X |
| 23 | C | Yes | 2.0 | F + M | 0.28 | No | 211 | 387 | 0.0 | 48 | 0.0 | ○ |
| 24 | C | Yes | 70 | F + M | 0.56 | Yes | 208 | 457 | 0.0 | 41 | 0.0 | X |
| 25 | D | No | 0.7 | F | 0.14 | No | 289 | 374 | 1.9 | 63 | 2.3 | X |
| 26 | D | No | 2.7 | F + M + B | 0.28 | No | 234 | 406 | 0.0 | 55 | 0.0 | ○ |
| 27 | D | No | 60 | F + M | 0.53 | Yes | 225 | 423 | 0.0 | 43 | 0.0 | X |
| 28 | E | Yes | 0.5 | F | 0.11 | No | 266 | 340 | 2.3 | 66 | 4.3 | X |
| 29 | E | Yes | 2.8 | F + M | 0.19 | No | 202 | 374 | 0.0 | 55 | 0.0 | ○ |
| 30 | E | Yes | 60 | F + M | 0.52 | Yes | 208 | 397 | 0.0 | 51 | 0.0 | X |

Notes:

1. The cooling rate is the result of measurement at the center in the widthwise direction of a steel sheet.
2. Alloying treatment: No indicates that alloying treatment (galvannealing) was not carried out after hot dip galvazining, and Yes indicates that alloying treatment was carried out.
3. Microstructure: F indicates ferrite, M indicates martensite, and B indicates bainite.
4. Surface defects: No indicates that surface defects did not develop, and Yes indicates that surface defects developed.
5. YPE after aging is the YPE after holding for 3 months in a furnace at 40 degrees C.
6. Comments: CICRLE indicates an example of the present invention, and X indicates a comparative example.

Test numbers 17, 20, 23, 26, and 29 for which the metallurgical structure had a ferrite phase and a low temperature transformation product including martensite and for which the value of $(Hv_{(max)}-Hv_{(ave)})/Hv_{(ave)}$ was less than 0.5 did not develop any surface defects, and while exhibiting a high bake hardenability of at least 48 MPa, YPE after aging was at most 0.1%, so they exhibited good anti room temperature aging property.

In contrast, in test numbers 16, 19, 22, 25, and 28 for which the metallurgical structure was a single phase of ferrite or a dual phase structure of a ferrite phase with a bainite phase, YPE after aging was large and anti room temperature aging property was poor.

For test numbers 18, 21, 24, 27, and 30 in which the value of $(Hv_{(max)}-Hv_{(ave)})/Hv_{(ave)}$ was larger than 0.5, surface defects developed in the surface of the steel sheet after working, and the surface condition was poor.

EXAMPLE 3

Slabs having the compositions shown in Table 4 were manufactured by continuous casting. The slabs were heated to 1240° C. and then hot rolled at a temperature of at least 900° C., and after cooling, they were coiled at 600° C. to obtain hot-rolled coils with a sheet thickness of 4.0 mm. The resulting hot-rolled coils were pickled and then cold rolled to a thickness of 0.8 mm.

TABLE 4

| | Chemical Composition (%) (Remainder: Fe and unavoidable impurities) | | | | | | | | | | | $Ac_1$ trans-formation | $Ac_3$ trans-formation | T1 | T2 |
|---|---|---|---|---|---|---|---|---|---|---|---|---|---|---|---|
| Steel | C | Si | Mn | P | S | sol. Al | N | Cr | B | Mo | Ti | point (° C.) | point (° C.) | (° C.) | (° C.) |
| F | 0.0015 | 0.01 | 1.43 | 0.014 | 0.004 | 0.047 | 0.0024 | 0.74 | — | — | — | 807 | 846 | 337 | 262 |
| G | 0.014 | 0.01 | 1.45 | 0.015 | 0.005 | 0.043 | 0.0025 | 0.72 | — | — | — | 776 | 831 | 339 | 237 |
| H | 0.025 | 0.01 | 1.45 | 0.016 | 0.005 | 0.044 | 0.0025 | 0.75 | — | — | — | 758 | 823 | 340 | 214 |
| I | 0.054 | 0.01 | 1.43 | 0.015 | 0.004 | 0.046 | 0.0023 | 0.73 | — | — | — | 752 | 805 | 348 | 157 |
| J | 0.026 | 0.01 | 0.31 | 0.014 | 0.004 | 0.045 | 0.0045 | 0.34 | — | — | — | 765 | 861 | 418 | 259 |
| K | 0.023 | 0.01 | 2.25 | 0.014 | 0.005 | 0.048 | 0.0025 | 0.35 | — | — | — | 744 | 810 | 320 | 206 |
| L | 0.024 | 0.01 | 2.79 | 0.015 | 0.005 | 0.042 | 0.0024 | 0.33 | — | — | — | 739 | 797 | 294 | 188 |
| M | 0.025 | 0.01 | 0.72 | 0.014 | 0.005 | 0.042 | 0.0026 | 0.55 | 0.0005 | — | — | 767 | 856 | 387 | 242 |
| N | 0.024 | 0.01 | 1.73 | 0.015 | 0.004 | 0.043 | 0.0026 | 0.94 | 0.0004 | — | 0.014 | 772 | 828 | 316 | 202 |
| O | 0.024 | 0.01 | 1.44 | 0.015 | 0.005 | 0.045 | 0.0024 | 0.73 | — | — | 0.021 | 760 | 833 | 341 | 217 |
| P | 0.025 | 0.01 | 1.43 | 0.015 | 0.005 | 0.044 | 0.0024 | 0.76 | — | 0.14 | — | 762 | 840 | 341 | 214 |

Notes:

1. The $Ac_1$ transformation point and the $Ac_3$ transformation point were measured from the thermal expansion curve at a heating rate of 10 degrees C./sec.
2. Temperature T1 = 445 + 200 × C % − 50 × (Mn % + Cr %) Temperature T2 = 330 − 2000 × C % − 30 × (Mn % + Cr %)

Subsequently, using a continuous annealing apparatus, the cold-rolled steel sheets were soaked for 30 seconds at the various temperatures shown in Table 5, and then they were cooled to 680° C. at a rate of 3° C./sec, rapidly cooled to the slow cooling starting temperature Ts at a rate of at 80° C./sec, then slowly cooled from the slow cooling starting temperature Ts to the slow cooling finishing temperature Tf at a nearly constant cooling rate of less than 10° C./sec, then cooled to 180° C. at a rate of 15° C./sec, and then cooled to room temperature at a rate of at least 100° C./sec.

TABLE 5

| Test No. | Steel | Soaking temperature (° C.) | Ts (° C.) | Tf (° C.) | Cooling rate (° C./s) between Ts and Tf |
|---|---|---|---|---|---|
| 31 | F | 820 | 390 | 200 | 1.3 |
| 32 | G | 780 | 390 | 200 | 1.3 |
| 33 | H | 780 | 390 | 200 | 1.3 |
| 34 | I | 780 | 390 | 200 | 1.3 |
| 35 | J | 770 | 390 | 200 | 1.3 |
| 36 | K | 770 | 390 | 200 | 1.3 |
| 37 | L | 770 | 390 | 200 | 1.3 |
| 38 | M | 800 | 390 | 200 | 1.3 |
| 39 | N | 800 | 390 | 200 | 1.3 |
| 40 | O | 780 | 390 | 200 | 1.3 |
| 41 | F | 820 | 330 | 250 | 0.5 |
| 42 | G | 780 | 330 | 250 | 0.5 |
| 43 | H | 780 | 330 | 250 | 0.5 |
| 44 | I | 780 | 330 | 250 | 0.5 |
| 45 | J | 770 | 330 | 250 | 0.5 |
| 46 | K | 770 | 330 | 250 | 0.5 |
| 47 | L | 770 | 330 | 250 | 0.5 |
| 48 | M | 800 | 330 | 250 | 0.5 |
| 49 | N | 800 | 330 | 250 | 0.5 |
| 50 | O | 780 | 330 | 250 | 0.5 |
| 51 | G | 780 | 350 | 220 | 0.9 |
| 52 | H | 780 | 350 | 220 | 0.9 |
| 53 | K | 770 | 350 | 220 | 0.9 |
| 54 | M | 800 | 350 | 220 | 0.9 |
| 55 | N | 800 | 350 | 220 | 0.9 |
| 56 | O | 780 | 350 | 220 | 0.9 |
| 57 | G | 780 | 370 | 200 | 1.1 |
| 58 | H | 780 | 370 | 200 | 1.1 |
| 59 | K | 770 | 370 | 200 | 1.1 |
| 60 | M | 800 | 370 | 200 | 1.1 |
| 61 | N | 860 | 370 | 200 | 1.1 |
| 62 | O | 850 | 370 | 200 | 1.1 |
| 63 | G | 850 | 370 | 200 | 1.1 |
| 64 | G | 750 | 370 | 200 | 1.1 |

TABLE 5-continued

| Test No. | Steel | Soaking temperature (° C.) | Ts (° C.) | Tf (° C.) | Cooling rate (° C./s) between Ts and Tf |
|---|---|---|---|---|---|
| 65 | H | 780 | 500 | 350 | 1.0 |
| 66 | M | 880 | 390 | 200 | 1.3 |
| 67 | P | 800 | 390 | 200 | 1.3 |
| 68 | P | 880 | 390 | 200 | 1.3 |

Note:
Each temperature indicates the result of measurement at the center in the widthwise direction of a steel sheet.

Thereafter, the annealed steel sheets were subjected to temper rolling with an elongation of 0.5%, and their properties were evaluated. A portion of the annealed steel sheets underwent electroplating treatment before temper rolling with an elongation of 0.5%, and their properties were evaluated.

The surface condition after working was evaluated by cutting a test piece with a length of 1200 mm and a width of 500 mm in a direction perpendicular to the rolling direction of the annealed steel sheets or the electroplated steel sheets, imparting a tensile strain of 5% to the test piece, rubbing the surface of the test piece with an oil whetstone, and then observing it for the presence or absence of surface defects.

The yield stress (YS), the tensile strength (TS), the yield point elongation (YPE), and the total elongation were determined by carrying out a tensile test using a JIS No. 5 tensile test piece taken in the widthwise direction.

Bake hardenability was evaluated by taking a JIS No. 5 test piece in the widthwise direction of the sheet from the annealed steel sheets or the electroplated steel sheets, imparting a 2% tensile pre-strain to it, subjecting the test piece to heat treatment at 170° C. for 20 minutes, and then carrying out a tensile test thereon. The difference between the resulting YS and the 2% flow stress was defined as the amount of bake hardenability (BH), and this was used as an index of bake hardenability.

Anti room temperature aging property was evaluated by taking a JIS No. 5 test piece in the widthwise direction of the sheets from the annealed steel sheets or the electroplated steel sheets, holding it for 3 months in an electric furnace set at 40° C., and then conducting a tensile test thereon to measure the yield point elongation (YPE).

The results of the evaluation of properties are shown in Table 6.

TABLE 6

| Test No. | Steel | Steel type | micro-structure | (Hv(max) − Hv(ave))/Hv(ave) | Surface bumpiness | YS (MPa) | TS (MPa) | YPE (%) | Total elongation (%) | BH (MPa) | YPE (%) after aging | Comments |
|---|---|---|---|---|---|---|---|---|---|---|---|---|
| 31 | F | CR | acicular F | 0.22 | No | 267 | 324 | 0.9 | 43.1 | 26 | 1.8 | X |
| 32 | G | CR | F + M + B | 0.25 | No | 224 | 391 | 0.0 | 40.8 | 68 | 0.0 | ○ |
| 33 | H | CR | F + M | 0.20 | No | 239 | 424 | 0.0 | 38.3 | 56 | 0.0 | ○ |
| 34 | I | CR | F + M | 0.51 | Yes | 394 | 593 | 0.0 | 29.3 | 56 | 0.0 | X |
| 35 | J | CR | F | 0.57 | Yes | 207 | 280 | 1.5 | 48.0 | 49 | 2.2 | X |
| 36 | K | CR | F + M | 0.21 | No | 250 | 469 | 0.0 | 34.6 | 53 | 0.0 | ○ |
| 37 | L | CR | F + M | 0.51 | Yes | 302 | 601 | 0.0 | 26.0 | 47 | 0.0 | X |
| 38 | M | CR | F + M + B | 0.21 | No | 213 | 344 | 0.0 | 45.1 | 70 | 0.1 | ○ |
| 39 | N | CR | F + M | 0.22 | No | 245 | 470 | 0.0 | 34.7 | 48 | 0.0 | ○ |
| 40 | O | CR | F + M | 0.19 | No | 234 | 418 | 0.0 | 40.2 | 51 | 0.0 | ○ |
| 41 | F | CR | acicular F | 0.52 | Yes | 273 | 338 | 0.8 | 41.3 | 28 | 1.5 | X |
| 42 | G | CR | F + M | 0.57 | Yes | 214 | 402 | 0.0 | 39.6 | 63 | 0.0 | X |
| 43 | H | CR | F + M | 0.59 | Yes | 232 | 431 | 0.0 | 37.5 | 52 | 0.0 | X |
| 44 | I | CR | F + M | 0.59 | Yes | 379 | 607 | 0.0 | 28.8 | 50 | 0.0 | X |
| 45 | J | CR | F | 0.56 | Yes | 213 | 296 | 1.7 | 45.3 | 44 | 2.8 | X |
| 46 | K | CR | F + M | 0.52 | Yes | 247 | 488 | 0.0 | 33.2 | 48 | 0.0 | X |
| 47 | L | CR | F + M | 0.51 | Yes | 301 | 614 | 0.0 | 25.6 | 40 | 0.0 | X |
| 48 | M | CR | F + M + B | 0.58 | Yes | 191 | 341 | 0.0 | 44.3 | 68 | 0.1 | X |
| 49 | N | CR | F + M + γ | 0.52 | Yes | 236 | 485 | 0.0 | 35.2 | 42 | 0.0 | X |
| 50 | O | CR | F + M + B | 0.56 | Yes | 226 | 413 | 0.0 | 39.9 | 44 | 0.0 | X |
| 51 | G | EG | F + M | 0.17 | No | 222 | 406 | 0.0 | 42.2 | 60 | 0.0 | ○ |

TABLE 6-continued

| Test No. | Steel | Steel type | micro-structure | (Hv(max) − Hv(ave))/ Hv(ave) | Surface bumpiness | YS (MPa) | TS (MPa) | YPE (%) | Total elongation (%) | BH (MPa) | YPE (%) after aging | Comments |
|---|---|---|---|---|---|---|---|---|---|---|---|---|
| 52 | H | EG | F + M | 0.51 | Yes | 234 | 423 | 0.0 | 37.9 | 50 | 0.0 | X |
| 53 | K | EG | F + M | 0.52 | Yes | 248 | 480 | 0.0 | 34.0 | 42 | 0.0 | X |
| 54 | M | CR | F + M + B | 0.58 | Yes | 197 | 343 | 0.0 | 43.7 | 65 | 0.0 | X |
| 55 | N | CR | F + M | 0.50 | Yes | 239 | 488 | 0.0 | 33.3 | 45 | 0.0 | X |
| 56 | O | CR | F + M | 0.51 | Yes | 223 | 421 | 0.0 | 39.6 | 45 | 0.0 | X |
| 57 | G | CR | F + M + B | 0.20 | No | 216 | 395 | 0.0 | 40.3 | 65 | 0.0 | ○ |
| 58 | H | EG | F + M | 0.20 | No | 237 | 423 | 0.0 | 38.3 | 51 | 0.0 | ○ |
| 59 | K | EG | F + M | 0.19 | No | 250 | 470 | 0.0 | 34.9 | 45 | 0.0 | ○ |
| 60 | M | CR | F + M + B | 0.58 | Yes | 208 | 345 | 0.0 | 44.8 | 65 | 0.0 | X |
| 61 | N | EG | F + M | 0.18 | No | 238 | 462 | 0.0 | 36.2 | 42 | 0.0 | ○ |
| 62 | O | EG | F + M | 0.20 | No | 224 | 410 | 0.0 | 43.3 | 44 | 0.0 | ○ |
| 63 | G | CR | F + M + B | 0.24 | No | 238 | 395 | 0.0 | 43.5 | 53 | 0.1 | ○ |
| 64 | G | CR | F | 0.25 | No | 296 | 382 | 2.7 | 38.4 | 72 | 3.4 | X |
| 65 | H | CR | B | 0.51 | Yes | 281 | 403 | 0.0 | 36.5 | 53 | 0.9 | X |
| 66 | M | CR | F + M | 0.26 | No | 206 | 340 | 0.0 | 47.3 | 65 | 0.0 | ○ |
| 67 | P | CR | F + M | 0.23 | No | 228 | 460 | 0.0 | 35.1 | 52 | 0.0 | ○ |
| 68 | P | EG | F + M | 0.22 | No | 211 | 436 | 0.0 | 39.2 | 55 | 0.0 | ○ |

Notes:
1. Steel type: CR indicates cold-rolled steel sheet, EG indicates electroplated steel sheet.
2. Microstructure: F indicates ferrite, M indicates martensite, B indicates bainite, γ indicates retained austenite, and acicular F indicates acicular ferrite.
3. Surface defects: No indicates that defects did not occur, and Yes indicates that defects occurred.
4. YPE after aging: YPE after holding for 3 months in a furance at 40 degrees C.
5. Comments: CIRCLE indicates an example of the present invention, and X indicates a comparative example.

The test results for cold-rolled steel sheets or electroplated steel sheets manufactured under conditions within the range of the present invention (test numbers 32, 33, 36, 38, 39, 40, 51, 57, 58, 59, 61, 62, 63, 66, 67, and 68) did not have any occurrence of surface defects, YS was at most 250 MPa, YPE was 0%, and the total elongation was at least 34%, so these steel sheets exhibited good press formability. In addition, the bake hardenability was at least 42 MPa, and the sheets exhibited excellent bake hardenability. Furthermore, YPE after aging for 3 months at 40° C. was at most 0.1%, so the sheets exhibited good anti room temperature aging property.

In contrast, when the metallurgical structure of a steel sheet or the method of manufacturing a steel sheet was outside the range prescribed by the present invention, the test results were such that one of YS, YPE, bake hardenability, YPE after aging, and surface condition was poor.

Specifically, a low temperature transformation product containing martensite was not formed and the YS and YPE were high with a large YPE after aging for test number 31 and 41 because of a low C content in the steel, for test number 64 because of the soaking temperature which was too low, and for test number 65 because of the slow cooling starting temperature Ts which was too high. In addition, the bake hardenability was low for test numbers 31 and 41.

The Mn content in the steel was low for test numbers 35 and 45, so the structure was a single phase of ferrite, YPE was high, and YPE after aging was also large.

For test numbers 34, 35, 37, 41, 42, 43, 44, 45, 46, 47, 48, 49, 50, 52, 53, 54, 55, 56, 60, and 65, cooling was carried out at a cooling rate of at least 10° C./sec in the temperature region between temperature $T_1$ prescribed by Equation (2) and temperature $T_2$ prescribed by Equation (3), so linear surface defects developed.

The invention claimed is:

1. A cold-rolled steel sheet characterized by having a structure comprising a main phase which is a ferrite and a secondary phase which is a low temperature transformation product including a martensite, with the hardness distribution of the ferrite phase in an arbitrary cross section having a length of 10 mm in the widthwise direction of the sheet satisfying the following Equation (1):

$$Hv_{(max)}-Hv_{(ave)}<0.4\times Hv_{(ave)} \quad (1)$$

wherein $Hv_{(max)}$ is the maximum Vickers hardness of ferrite grains in a region where the distance from the surface in the depth direction is at least (⅛)t and at most (¼)t when the thickness of the cold-rolled steel sheet is t, and $Hv_{(ave)}$ is the average Vickers hardness of ferrite grains in this region, wherein the high-strength cold-rolled steel sheet has a steel composition consisting of, in mass percent, C: at least 0.0025% and at most 0.029%, Si: at most 0.5%, Mn: at least 0.5% and at most 2.5%, P: at most 0.05%, S: at most 0.01%, sol. Al: at most 0.15%, N: less than 0.008%, Cr: at least 0.02% and at most 2.0%, and a remainder of Fe and impurities and a yield strength of the cold rolled sheet in a direction perpendicular to a rolling direction is 300 MPa or less.

2. A plated steel sheet characterized by having a plating layer on the surface of a cold-rolled steel sheet as set forth in claim 1.

3. A cold-rolled steel sheet characterized by having a structure comprising a main phase which is a ferrite and a secondary phase which is a low temperature transformation product including a martensite, with the hardness distribution of the ferrite phase in an arbitrary cross section having a length of 10 mm in the widthwise direction of the sheet satisfying the following Equation (1):

$$HV_{(max)}-HV_{(ave)}<0.4\times Hv_{(ave)} \quad (1)$$

wherein $HV_{(max)}$ is the maximum Vickers hardness of ferrite grains in a region where the distance from the surface in the depth direction is at least (⅛)t and at most (¼)t when the thickness of the cold-rolled steel sheet is t, and $HV_{(ave)}$ is the average Vickers hardness of ferrite grains in this region, wherein the high-strength cold-rolled steel sheet has a steel composition consisting of, in mass percent, C: at least 0.0025% and at most 0.029%, Si: at most 0.5%, Mn: at least 0.5% and at most 2.5%, P: at most 0.05%, S: at most 0.01%, sol. Al: at most 0.15%, N: less than 0.008%, Cr: at least 0.02% and at most 2.0%, B: at most 0.003%, and a remainder of Fe and impurities and a yield strength of the cold rolled sheet in a direction perpendicular to a rolling direction is 300 MPa or less.

4. A plated steel sheet characterized by having a plating layer on the surface of a cold-rolled steel sheet as set forth in claim 3.

5. A cold-rolled steel sheet characterized by having a structure comprising a main phase which is a ferrite and a secondary phase which is a low temperature transformation product including a martensite, with the hardness distribution of the ferrite phase in an arbitrary cross section having a length of 10 mm in the widthwise direction of the sheet satisfying the following Equation (1):

$$HV_{(max)}-HV_{(ave)}<0.4\times Hv_{(ave)} \quad (1)$$

wherein $HV_{(max)}$ is the maximum Vickers hardness of ferrite grains in a region where the distance from the surface in the depth direction is at least (⅛)t and at most (¼)t when the thickness of the cold-rolled steel sheet is t, and $HV_{(ave)}$ is the average Vickers hardness of ferrite grains in this region, wherein the high-strength cold-rolled steel sheet has a steel composition consisting of, in mass percent, C: at least 0.0025% and at most 0.029%, Si: at most 0.5%, Mn: at least 0.5% and at most 2.5%, P: at most 0.05%, S: at most 0.01%, sol. Al: at most 0.15%, N: less than 0.008%, Cr: at least 0.02% and at most 2.0%, Ti: at most 0.1%, and a remainder of Fe and impurities and a yield strength of the cold rolled sheet in a direction perpendicular to a rolling direction is 300 MPa or less.

6. A plated steel sheet characterized by having a plating layer on the surface of a cold-rolled steel sheet as set forth in claim 5.

7. A cold-rolled steel sheet characterized by having a structure comprising a main phase which is a ferrite and a secondary phase which is a low temperature transformation product including a martensite, with the hardness distribution of the ferrite phase in an arbitrary cross section having a length of 10 mm in the widthwise direction of the sheet satisfying the following Equation (1):

$$Hv_{(max)}-Hv_{(ave)}<0.4\times Hv_{(ave)} \quad (1)$$

wherein $Hv_{(max)}$ is the maximum Vickers hardness of ferrite grains in a region where the distance from the surface in the depth direction is at least (⅛)t and at most (¼)t when the thickness of the cold-rolled steel sheet is t, and $Hv_{(ave)}$ is the average Vickers hardness of ferrite grains in this region, wherein the high-strength cold-rolled steel sheet has a steel composition consisting of, in mass percent, C: at least 0.0025% and at most 0.029%, Si: at most 0.5%, Mn: at least 0.5% and at most 2.5%, P: at most 0.05%, S: at most 0.01%, sol. Al: at most 0.15%, N: less than 0.008%, Cr: at least 0.02% and at most 2.0%, Ti: at most 0.1%, B: at most 0.003%, and a remainder of Fe and impurities and a yield strength of the cold rolled sheet in a direction perpendicular to a rolling direction is 300 MPa or less.

8. A plated steel sheet characterized by having a plating layer on the surface of a cold-rolled steel sheet as set forth in claim 7.

* * * * *